United States Patent [19]

Malmström et al.

[11] 4,100,887

[45] Jul. 18, 1978

[54] IMPROVMENTS IN OR RELATING TO BOILERS

[76] Inventors: Karl Gunnar Malmström, 1 Privatvägen, S-132 00 Saltsjö-boo; Karl Lennart Mattsson, 28 Erstaviksvägen, S-130 12 Alta, both of Sweden

[21] Appl. No.: 743,180

[22] Filed: Nov. 19, 1976

[30] Foreign Application Priority Data

Dec. 3, 1975 [SE] Sweden ..... 75136101
Feb. 4, 1976 [SE] Sweden ..... 7601220

[51] Int. Cl.[2] ..... F22B 37/52

[52] U.S. Cl. ..... 122/379; 122/390; 165/95

[58] Field of Search ..... 122/379, 390, 391, 396, 122/405; 165/95

[56] References Cited

U.S. PATENT DOCUMENTS

| | | | |
|---|---|---|---|
| 1,317,658 | 9/1919 | Johnson | 122/379 |
| 1,565,304 | 12/1925 | Bell | 122/390 |
| 2,103,789 | 12/1937 | Mosshart | 122/390 |
| 2,949,282 | 8/1960 | Kirkby | 122/379 |
| 3,415,231 | 12/1968 | Reale | 122/390 |

*Primary Examiner*—Kenneth W. Sprague

*Attorney, Agent, or Firm*—Kinzer, Plyer, Dorn & McEachran

[57] ABSTRACT

A boiler of the type having a convection enclosure with convection surfaces in which the convection enclosure is partially enclosed by walls which form a downwardly closed water-tight container. These walls extend downwardly to at least the upper portion of the convection enclosure. Inlet and outlet piping and valves are provided for the water-tight container to permit the container to be filled with water for dissolving soot and other deposits on the convection surfaces in order to clear the surfaces and to remove the contaminated water from the water-tight container. The inlet piping is equpped with nozzles located above the convection enclosure to distribute the rinsing water on the convection surfaces. Chemicals may be mixed with the rinsing water for the purpose of neutralizing the contaminated water prior to removal. An electrode supplied by a source of direct current voltage is located inside the water-tight container with the direct current source also connected to the boiler wall and convention enclosure. A switch device is provided to reverse the polarity of the electrode and the boiler wall and convection enclosure.

7 Claims, 3 Drawing Figures

IMPROVMENTS IN OR RELATING TO BOILERS

The present invention relates to boilers, and more particularly, but not exclusively, to high-temperature-water boilers, such as central-heating boilers.

Central-heating boilers normally comprise a convection enclosure having convection surfaces arranged for contact with hot flue gases of combustion. These surfaces often become coated with soot and other deposits, such as fly ash and slag, depending upon the type of fuel used, and must regularly be cleaned.

Normally, soot accumulated on the convection surfaces is removed therefrom with water which is caused to flow over said surfaces. The water is normally supplied through fixed or moveable nozzles connected to a system of pipes. In order not to damage the convection surfaces, the amount of water used is such that the pH of the resultant soot-water mixture is approximately 7. The soot-contaminated water is passed from the boiler to a tank which is able positively to accommodate all the water required to effect a de-sooting operation. The contaminated water collected in the tank may not be discharged to the communal sewage system or to the environment before said water has been neutralised. The quantity of water required to obtain a satisfactory result when using this method is relatively high, requiring a tank of relatively large volume.

An object of the invention is to provide a boiler having a convection section which can be effectively de-sooted while using less water than was previously the case.

Accordingly, this invention consists in a boiler of the type having a convection enclosure provided with convection surfaces, wherein the convection enclosure is partially enclosed by walls which form a downwardly closed, water-tight container, said walls extending at least to the upper portion of the convection enclosure; wherein filling means are arranged which permit the container to be filled with water for dissolving soot and other deposits on said convection surfaces so as to clean said surfaces; and wherein means are provided for removing the contaminated water from the container.

Since the water remains in the container until soot and other deposits have losened from the convection surfaces, the only water required to effect a de-sooting operation will be that accommodated by the container. In addition to this water, additional water may be required for rinsing purposes. This rinsing water may be supplied through the same water supply system as the de-sooting water. The small quantity of soot-contaminated water contained by the container could, in principle, be tapped off into a small collecting vessel for subsequent treatment, such as a neutralising operation. A simpler expedient, however, would be to arrange means for admixing known chemicals with the water in the container to neutralise the water prior to tapping it therefrom. Suitably, the water is supplied through nozzles arranged above the convection section and connected to a water pipe via a closing valve controlled by a level-sensing device arranged in the container.

Exemplary embodiments of the invention will now be described in more detail with reference to the accompanying schematic drawing, in which.

Figure 1:
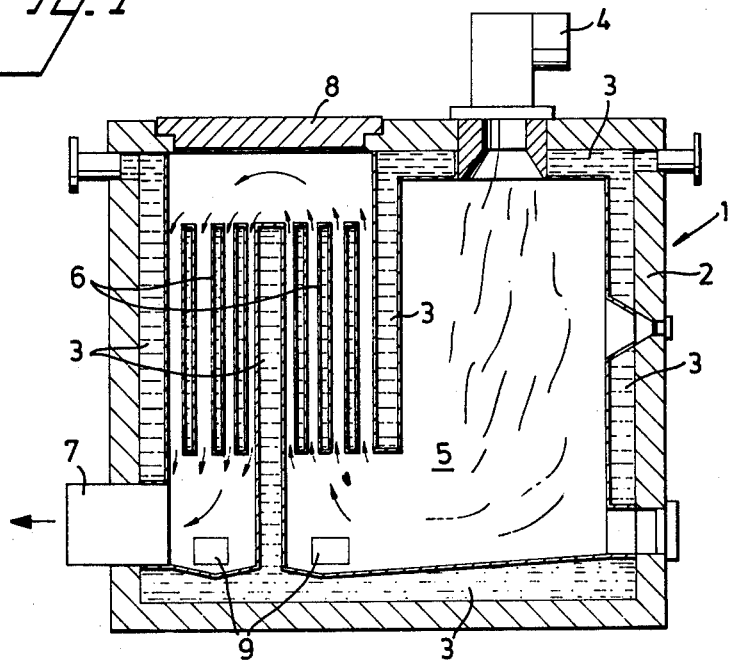
FIG. 1 is a sectioned elevational view of a known central-heating boiler.

In FIG. 1 there is shown a known boiler 1 having an outer wall 2 on the inside of which are arranged channels 3 through which a heat-exchange medium, such as water, passes. The boiler is fired by means of an oil burner 4. The hot gases of combustion, i.e. the flue gases, are passed from a combustion chamber 5, through a convection section 6 and out through an opening 7. The boiler is provided with an upper removable de-sooting panel 8 and a lower, removable de-sooting panel 9, these panels being provided to enable conventional de-sooting of the boiler. When the convection surfaces of the convection section 6 are to be de-sooted using water, said surfaces are flushed with water supplied through fixed nozzles, or through nozzles insertable into the upper portion of the convection section. The contaminated water is collected in a suitable manner beneath the convection section and is passed to a collecting tank (not shown). The soot-contaminated surfaces are flushed until the pH of the water approaches 7, this procedure requiring a considerable amount of water which must then be neutralised in the tank prior to emptying the same.

Figure 2:
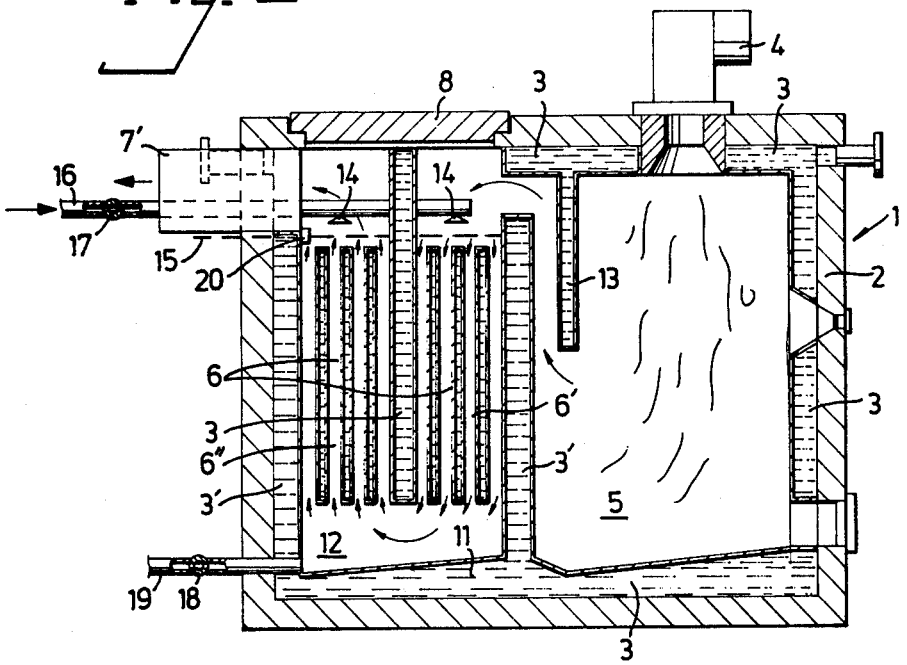
FIG. 2 is a sectioned elevational view of a first embodiment of a boiler constructed in accordance with the invention and FIG. 3 is a sectioned elevational view of a further embodiment of a boiler according to the invention.

In the boiler according to the invention shown in FIG. 2, the convection section 6 is partially enclosed by a chamber comprising hollow walls 3', which are preferably filled with water, and walls 11 of a trough 12 arranged beneath the convection section 6, said walls 11 sealingly engaging the walls 3'.

In this embodiment, the flue gases are passed around the lower edge of a vertically depending baffle plate 13 and upwardly to the upper portion of an inward part 6' of the convection section 6, from whence said gases pass downwardly through said inward part and, via the trough 12, upwardly through an outward part 6'' of the convection section 6, and out through a flue-gas opening 7'.

The walls 3' and 11 form a downwardly closed chamber which partially encloses the convection section 6. Arranged above the section 6 are two nozzles 14 which may either be permanently fixed or may be removable and which are connected to a water-pipe system 16, said nozzles being arranged to flush water onto the convection surfaces. The water is collected in the chamber comprising walls 3', 11, and when the level of the water reaches the level shown by the dash line 15 at the upper portion of the convection section 6, a valve 17 in the pipe 16 is closed by means of a suitable level-sensing device 20, and the water is permitted to remain in the chamber 3', 11 for a period of time sufficient to dissolve soot and other deposits from the said convection surfaces.

When spraying the water onto said surfaces, chemicals may be added to the water for neutralising the same to a level at which it is permitted to discharge the water to the sewage system, this discharge being effected through a bottom tapping pipe 19 provided with a valve 18.

Although the boiler illustrated in FIG. 2 is shown to be heated by means of an oil burner, it will be understood that any suitable form of fuel can be used, such as solid fuel or gas.

The convection section may comprise a plurality of convection units mutually connected one to the other in series and/or in parallel.

Although the aforedescribed arrangement for de-sooting soot - contaminated convection surfaces with water has been found much more efficient than arrangements using conventional spraying operations, and will result in a marked reduction in corrosion, the cleansing efficiency of the arrangement can be further enhanced by reducing the time taken to effect a cleaning operation, therewith lowering the corrosion tendency. In certain instances, when using strongly alkaline liquids for de-sooting purposes, a colloidal layer is liable to form on the convection surfaces coated with soot or other deposits, such layers prolonging the time required to effectively clean said surfaces. The arrangement shown in FIG. 3 eliminates this problem and increases the efficiency.

Figure 3:
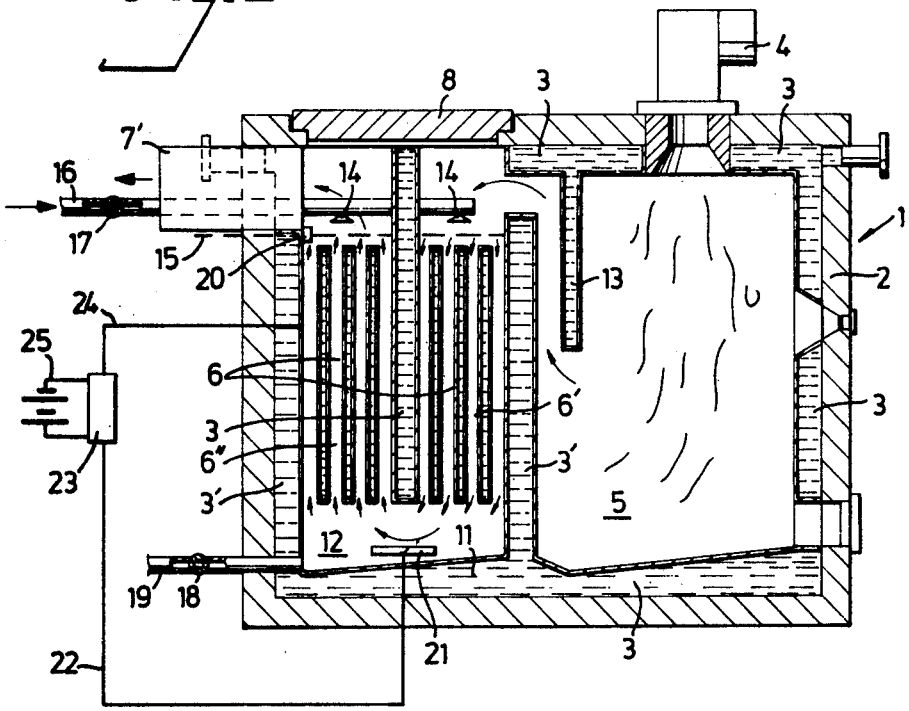

As with the arrangement described with reference to FIG. 2, the convection section 6 of the boiler 1 of the arrangement shown in FIG. 3 is also partially enclosed by hollow walls 3', which are preferably filled with water, and walls 11 of a trough 12 located beneath the convection section 6 and sealingly engaging the walls 3'.

The flue gases are passed around the lower edge of a vertical baffle 13, upwardly to the upper portion of a forward part 6' of the convection section 6, from whence the pass downwardly through said forward part and, through the trough 12, upwards through a rear portion 6' of the convection section 6, and out through a flue gas opening 7'.

The walls 3' and 11 form a downwardly closed chamber or container, which partially encloses the convection section 6, two fixed or movable nozzles 14 connected to a system of water pipes 16 being mounted above said convection section and arranged to flush the convection surfaces of said section 6. The water is collected in the container 3', 11. When the water reaches the level shown by the dash line 15, a valve 17 in the pipe 16 is closed by a level-sensing device 20 and the water is permitted to remain in the container 3', 11 until soot and other deposits have been losened from said surfaces of said convection section 6.

In the boiler shown in FIG. 3, an electrode 21 is arranged in direct contact with the liquid in the container 3', 11. In the illustrated embodiment, the electrode 21 is mounted within the trough 12, but may also comprise, for example, a portion of the wall 11, but must be galvanically insulated from the wall of the boiler. The electrode comprises a material having good electric conductivity and preferably presents the largest possible surface and may have any form whatsoever. The electrode 21 is connected to a sealed conductor 22 which extends through the bottom of the boiler and which is connected to a mechanically or manually operable alternator 23 from which there extends a conductor 24 which is connected to the wall 2 of the boiler 1 as close to the level of water 15 as possible. The alternator 23 is connected to a d.c. voltage source 25 which is arranged to supply a d.c. voltage to said wall 2 and to the convection section 6 which is in conducting connection with the boiler walls. The object of the alternator 23 is to enable any one of the poles of the d.c. voltage source to be connected to the collector electrode 21 and to the walls 2 and convection section 6 respectively of the boiler. Normally, however, the electrode 21 is connected to the positive terminal of the current source 25 and, in the majority of cases, the alternator 23 can be excluded.

When the collector electrode 21 is connected to the positive terminal of the voltage source and the wall 2 is connected to the negative terminal, negative ions or particles, for example, $Cl^-$, $SO_4^-$ and $SO_3^-$ ions, will be losened from the coated surfaces and migrate to or towards the electrode 21, while positive ions, such as $Na^+$ ions, will migrate to the boiler wall and the convection surfaces respectively. Thus, dissolution of the coating is effected more rapidly than in the case when solely liquid is used. Any colloids, which are formed when the water contains alkali, are rapidly dissolved thereby rendering it impossible for an impeding layer to form on the coatings.

Since the treatment time is considerably reduced, there is less risk of the boiler corroding.

When the coatings contain positive ions, these can be removed by the weak current passing through the electrode from the voltage source 25, in which case the aforementioned alternator 23 is suitably used for temporarily reversing the direction of current flow. The voltage and current through the liquid can be varied and optionally interrupted completely during the treatment time in dependence upon occurring salts and colloids.

We claim:

1. A boiler of the type having convection surfaces located adjacent to and in communication with a combustion chamber, a floor and upstanding walls forming a water-tight container for the convection surfaces with said walls extending sufficiently high to permit water to cover the convection surfaces while permitting communication with the combustion chamber, means for filling the water-tight container with water for dissolving soot and other deposits on the convection surfaces to clean said surfaces, and means for removing the contaminated water from the water-tight container.

2. The boiler of claim 1 in which said filling means include means to mix chemicals with the water supplied to the water-tight container for neutralizing the contaminated water prior to removing it.

3. The boiler of claim 1 in which said filling means includes nozzles arranged above the convection surfaces and connected to a water supply by a closing valve controlled by a level sensing device in the water-tight container.

4. The boiler of claim 1 in which an electrode is located in contact with the liquid in the water-tight container and a source of direct current voltage is connected between said electrode and a wall of the water-tight container which is in contact with the liquid.

5. The boiler of claim 4 in which the electrode is connected to the positive terminal of the source of direct current voltage.

6. The boiler of claim 4 in which the direct current voltage source is connected to the electrode and the wall of the water-tight container by means of a switch device to enable selective terminal connection.

7. A boiler of claim 4 in which the electrode is arranged in the lower part of the water-tight container.

* * * * *